US012171387B2

(12) United States Patent
Gross

(10) Patent No.: US 12,171,387 B2
(45) Date of Patent: Dec. 24, 2024

(54) DISHWASHER WITH OBJECT RECOGNITION

(71) Applicant: Idealab Studio, LLC, Pasadena, CA (US)

(72) Inventor: William Tod Gross, Pasadena, CA (US)

(73) Assignee: Idealab Studio, LLC, Pasadena, CA (US)

( * ) Notice: Subject to any disclaimer, the term of this patent is extended or adjusted under 35 U.S.C. 154(b) by 372 days.

(21) Appl. No.: 17/807,829

(22) Filed: Jun. 20, 2022

(65) Prior Publication Data

US 2022/0409005 A1 Dec. 29, 2022

Related U.S. Application Data

(60) Provisional application No. 63/214,952, filed on Jun. 25, 2021.

(51) Int. Cl.
*A47L 15/00* (2006.01)
*A47L 15/26* (2006.01)

(52) U.S. Cl.
CPC ..... *A47L 15/0021* (2013.01); *A47L 15/26* (2013.01); *A47L 2401/04* (2013.01)

(58) Field of Classification Search
CPC .. A47L 15/0021; A47L 15/26; A47L 2401/04; A47L 2501/36; A47L 15/507; A47L 2501/26; A47L 15/4295
See application file for complete search history.

(56) References Cited

U.S. PATENT DOCUMENTS

| | | | | |
|---|---|---|---|---|
| 11,439,292 | B2 * | 9/2022 | Ha | A47L 15/4297 |
| 11,692,767 | B2 * | 7/2023 | Schroeder | G06V 20/52 235/385 |
| 11,786,101 | B2 * | 10/2023 | Kara | A47L 15/4409 134/56 D |
| 11,950,743 | B2 * | 4/2024 | Disch | G06T 7/90 |
| 12,048,407 | B2 * | 7/2024 | Kara | G03B 17/561 |
| 2019/0343367 | A1 * | 11/2019 | Jung | A47L 15/00 |
| 2020/0034688 | A1 | 1/2020 | Lim et al. | |
| 2020/0093347 | A1 | 3/2020 | Shashidhar | |
| 2020/0301382 | A1 * | 9/2020 | Fawaz | G06T 7/73 |
| 2020/0337516 | A1 | 10/2020 | Frank et al. | |

(Continued)

*Primary Examiner* — Wesley J Tucker
(74) *Attorney, Agent, or Firm* — Knobbe, Martens, Olson & Bear LLP

(57) ABSTRACT

A dishwasher comprises an image sensor, first and second drawers, first and second actuators configured to respectively extend or retract the first and second drawers, and a computer system. The computer system is configured to receive images from the image sensor, determine whether an object is within a threshold distance, and in response to determining that an object is moved to within the threshold distance, use a washwear recognition system to determine whether the object comprises an washwear item. A determined washwear type and a washwear dimension are used to identify an unoccupied location in of a size and configured suitable to receive the washwear item. In response to identifying an unoccupied location of a size and configured suitable to receive the washwear item, an actuator among the first actuator and the second actuator is caused to extend a corresponding drawer to thereby receive the item of dishware.

27 Claims, 4 Drawing Sheets

(56) References Cited

U.S. PATENT DOCUMENTS

| | | | |
|---|---|---|---|
| 2020/0397216 | A1 | 12/2020 | Fawaz et al. |
| 2020/0397218 | A1 | 12/2020 | Fawaz et al. |
| 2021/0034026 | A1 | 2/2021 | Fawaz et al. |
| 2021/0085152 | A1 | 3/2021 | Shashidhar et al. |
| 2021/0093149 | A1 | 4/2021 | Fawaz et al. |
| 2021/0093150 | A1 | 4/2021 | Shin et al. |
| 2021/0093151 | A1 | 4/2021 | Boyer et al. |
| 2021/0093152 | A1 | 4/2021 | Boyer et al. |
| 2021/0093153 | A1 | 4/2021 | Boyer et al. |
| 2024/0065521 | A1* | 2/2024 | Hu ..... A47L 15/4295 |

* cited by examiner

DISHWASHER WITH OBJECT RECOGNITION

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

COPYRIGHT NOTICE

A portion of the disclosure of this patent document contains material which is subject to copyright protection. The copyright owner has no objection to the facsimile reproduction by anyone of the patent document and/or the patent disclosure as it appears in the United States Patent and Trademark Office patent file and/or records, but otherwise reserves all copyrights whatsoever.

BACKGROUND OF THE INVENTION

Field

The present disclosure generally relates to computerized dishwashers.

Description of the Related Art

Conventional dishwashers fail to provide any active, dynamic assistance to a user in loading washware into racks or baskets. Thus, conventional dishwashers are often not satisfactorily loaded. For example, users may load dishwasher racks in an inefficient fashion leading to fewer dishes being washed by load, hence wasting water and energy. Further, when users load dishwashers they may often pull out a rack, determine that it is full, and then pull out another rack in an effort to identify available rack space. This conventional approach results in undue wear on dishwasher components (e.g., rack tracks, glides, and rollers).

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

An aspect of the present disclosure relates to a dishwasher, comprising: an image sensor; a first drawer configured to receive washware; a second drawer configured to receive washware; a first actuator configured to extend or retract the first drawer configured to receive washware; a second actuator configured to extend or retract the second drawer configured to receive washware; a computer system configured to: receive one or more images from the image sensor; determine whether an object is moved to within a threshold distance of a first portion of the dishwasher; at least partly in response to determining that an object is moved to within the threshold distance of the first portion of the dishwasher, using a washwear recognition system to determine whether the object comprises an item of washwear; at least partly in response to determining that the object comprises an item of washwear, use a determined washwear type and a washwear dimension to identify an unoccupied location in the first drawer and/or second drawer of a size and configured suitable to receive the item of washwear; at least partly in response to identifying an unoccupied location in the first drawer and/or second drawer of a size and configured suitable to receive the item of washwear, command an actuator among the first actuator and the second actuator to extend a corresponding drawer to thereby receive the item of dishware.

An aspect of the present disclosure relates to a computer-implemented method comprising: receiving at a computer system of a dishwasher one or more images from an image sensor; using a washwear recognition system to determine whether the image comprises an item of washwear; at least partly in response to determining that the image comprises an item of washwear, use a determined washwear type and/or a washwear dimension to identify an unoccupied location in a dishwasher drawer of a size and configured suitable to receive the item of washwear; and at least partly in response to identifying an unoccupied location in the dishwasher drawer of a size and configured suitable to receive the item of washwear, commanding an actuator to extend the drawer to thereby receive the item of dishware.

An aspect of the present disclosure relates to a non-transitory memory that stores instructions that when executed by a computer system causes the computer system to perform operations comprising: receiving one or more images from an image sensor of a dishwasher; using a washwear recognition module to determine whether the image comprises an item of washwear; at least partly in response to determining that the image comprises an item of washwear, use a determined washwear type and/or a washwear dimension to identify an unoccupied location in a dishwasher drawer of a size and configured suitable to receive the item of washwear; and at least partly in response to identifying an unoccupied location in the dishwasher drawer of a size and configured suitable to receive the item of washwear, commanding an actuator to extend the drawer to thereby receive the item of dishware.

BRIEF DESCRIPTION OF THE DRAWINGS

Embodiments will now be described with reference to the drawings summarized below. These drawings and the associated description are provided to illustrate example aspects of the disclosure, and not to limit the scope of the invention.

DETAILED DESCRIPTION

Figure 1:
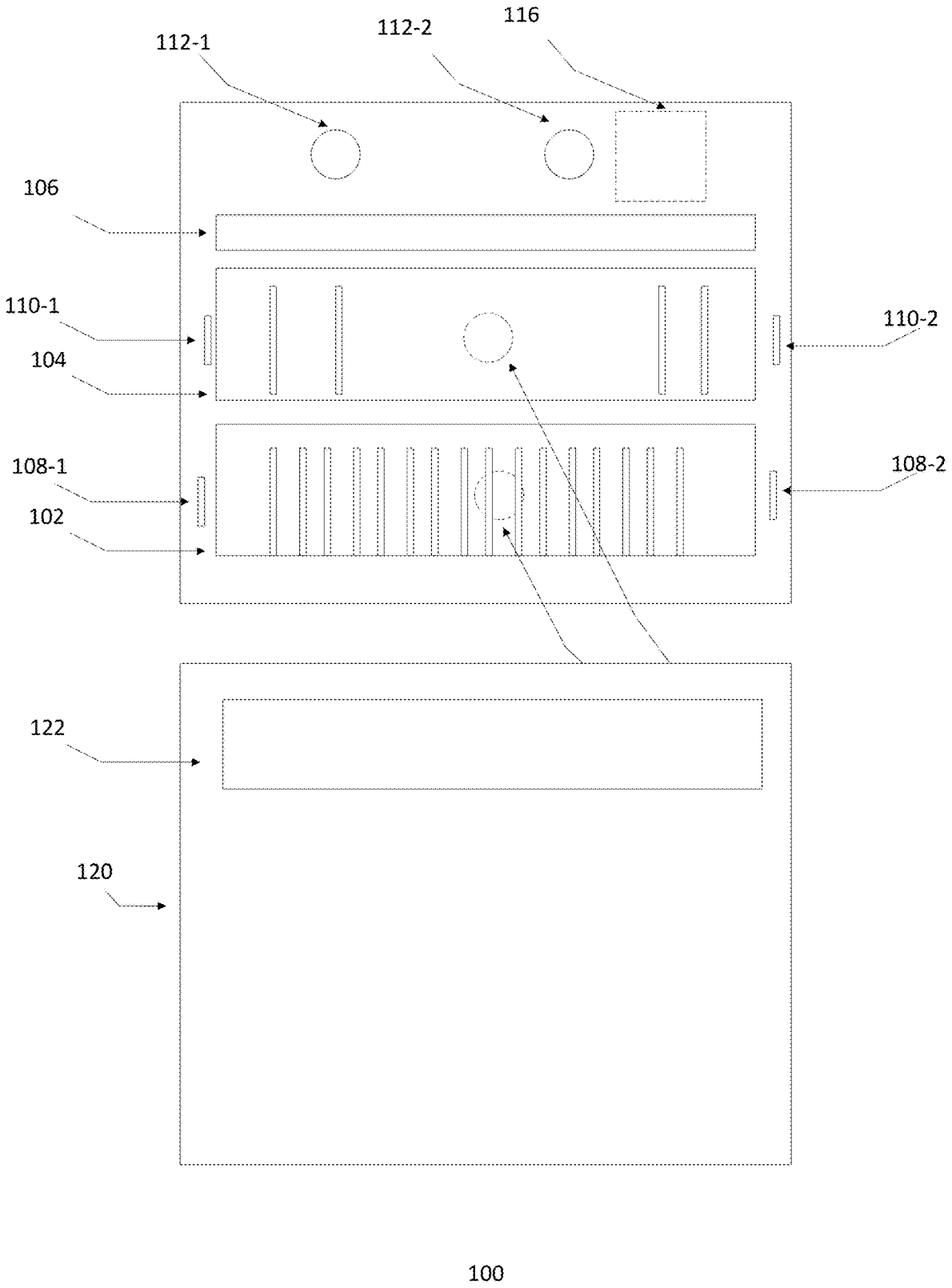
FIG. 1 illustrates an example dishwasher.

As similarly discussed above, conventional dishwashers are often not satisfactorily loaded. For example, users may load dishwasher racks in an inefficient fashion leading to fewer dishes being washed by load, hence wasting water and energy. Further, when users load dishwashers they may often pull out a rack, determine that it is full, and then pull out another rack in an effort to identify available rack space. This conventional approach results in undue wear on dishwasher components. These and other technical challenges are addressed herein. For example, an aspect of the present disclosure relates to automatically identifying available dishwasher drawer locations for an item of washware that will provide efficient loading (where more items of washware may be loaded and washed at a time) than conventionally.

An aspect of the present disclosure relates to a dishwasher equipped with one or more sensors configured to image or otherwise perceive items, such as washware, being loaded into the dishwasher for cleaning. By way of example, washware may include dishes (e.g., plates, bowls, cups, glassware, platters), utensils, pots, pans, knives, spoons, forks, or the like. Based at least in part on the perception of washware, the dishwasher is configured to aid a user in loading the washware into the dishwasher in an efficient manner.

For example, the dishwasher may include a camera and a computer system comprising a microprocessor. The camera may be configured to take pictures of each item of washware as the washware approaches the dishwasher. One or more images of the washware may then be transmitted to the computer system and analyzed using object recognition software to determine the washware type and/or dimensions. Based on the type of washware the user is determined to be holding and/or the washware dimensions, the computer system selects and dishwasher actuators extend an appropriate dishwasher drawer (e.g., a bottom rack, middle rack, or a top rack) to assist the user in depositing the dish.

For example, based on a size (e.g., dimensions, surface area, diameter, height, length, thickness, and/or other size characteristics), shape (e.g., bowl-shaped, flat-shaped, irregularly shaped, and/or other shapes) of a detected item of washware, a determined heat sensitivity of the item of washware (where different drawers may be subject to different temperature water, such as where a lower drawer may be subject to higher temperatures relative to a higher drawer), and on a determined space availability of one or more dishwasher drawers or bins, a computer system may determine which drawer, or bin (which may be at times collectively referred to as drawers) has available space or a rack of the appropriate size and configuration to receive the item of washware. The computer system may then actuate a transport device to cause the appropriate drawer to extend to receive the washware from the user. The computer may detect when the washware has been placed in the extended drawer (e.g., using an imager, a vibration detector, a weighing transducer, and/or otherwise) and at least partly in response, automatically retract the extended drawer. Optionally, the drawer may be configured to remain extended until the user manually instructs (e.g., via a physical button, a touch control, a hand gesture, a voice command, and/or otherwise) the dishwasher to retract the drawer.

Optionally, the computer system may generate a user instruction/prompt as to where to place the detected washware in the extended drawer (e.g., for optimal, dense packing and/or for best cleaning). For example, a map comprising a representation of the extended drawer with an indication (e.g., an arrow, highlighting, text, graphics) as to what locations are currently occupied and/or an indication as to where the detected washware is recommended to be placed may be generated and displayed via a dishwasher display, via a dedicated application (e.g., an app downloaded from an app store) hosted on a user device, via a webpage that accesses the map from a web-application hosted on a service, or otherwise. Optionally, the drawer may include user viewable location identifiers which may be reflected in the map. For example, various areas of the drawer may be color-coded and/or may include printed or molded alphanumeric and/or graphical (e.g., icons) identifiers which may be reflected in the map. The map and/or other user instructions may include or highlight the indicator corresponding to where the detected washware is to be placed.

In addition or instead, the computer system may generate vocal prompts as to where the washware is to be placed (e.g., place the plate in the third slot from the right, place the plate at slot B3, etc.). Optionally, in addition or instead, respective drawer washware locations may include respective visual, computer controlled indicators (e.g., LEDs), where a given visual indicator may be commanded to be illuminated by the computer system to indicate where the washware is to be placed.

Optionally, the computer system may be configured to identify multiple acceptable locations for a given item of washware. The user map, the audible instructions, and/or other instructions may identify some or all of the acceptable locations. Optionally, the computer system will only identify what is determined to be the optimal location for the washware based on one or more criteria (e.g., to enable washware items to be more densely packed, to enhance liquid spray distribution, and/or the like). Optionally, the dishwasher does not prompt the user to place the dishwasher in a specific drawer location, but instead simply extends the drawer and the user selects an appropriate drawer location for the washware.

Optionally, if the computer system detects that there is no available space for the detected washware in any drawer (e.g., as determined from an image captured of the drawers and/or a map of the drawers that is updated each time an item of washware is placed in a drawer), no drawer is extended and instead a corresponding alert may be generated (e.g., an audible, visual, or electronic message alert) and presented to the user.

The computer system may be integrated into the dishwasher housing or the computer system may be physically separate from the dishwasher, where the computer system communicates with the dishwasher sensors, actuators, and/or other computer-controlled components, wirelessly (e.g., via Bluetooth, Wi-Fi, Zigbee, a cellular network, or other protocol), or via a wired connection (e.g., Ethernet).

The dishwasher may be configured to cause a drawer to extend in response to identifying an item of washware that is within a threshold distance of the dishwasher or a specified portion thereof. Such distance may be determined, by way of example, visually via an imager (e.g., as described elsewhere herein), via a LIDAR (Light Detection and Ranging) sensor, via a millimeter wave radar, and/or via an ultrasonic sonar (sound navigation ranging) system.

Optionally, the dishwasher may be configured with an imager comprising one or cameras configured to capture still and/or video images of each item of washware when positioned within view of the imager and/or within a certain range of the imager. The imager may be connected to an object recognition system that can identify when a user holding an item of washware is in the image. The object recognition system may isolate the washware from the user, and identify the washware type, shape, and/or dimensions.

The dishwasher may be configured with one or more detections sensors, such as imagers, LIDARs, millimeter wave radars, ultrasonic sonar systems, and/or the like configured to detect which locations of a given drawer are occupied by an item of washware and which locations are available to receive an item of washware. Such sensors may be located on the top, rear, left, right, and/or bottom walls of the dishwasher interior (e.g., the dishwasher tub walls) and/or walls and may face the interior of the dishwasher tub and/or drawers.

The detection sensor may comprise two or more sensors (e.g., stereo camera) to provide at least stereoscopic vision and to enable the distance of the washware from the dishwasher to be determined using stereoscopic ranging. For example, where stereo cameras are used, based on the position of the washware in each camera image, the distance between the cameras, and the cameras' respective view field angles, the distance of the washware from the cameras may be determined. Optionally, mono range detecting sensor systems may be utilized. For example, a mono camera may be utilized to estimate the distance based on reference points in the camera's view field or using instance segmentation and the focal length of the camera.

In addition, the dishwasher may be equipped with one or more weight measurement devices (e.g., weight transducers) configured to measure the weight of a given drawer to determine how heavily loaded the drawer is. For example, a weight transducer may be configured to convert the drawer load into a corresponding electrical output signal. The transducer may be in the form of a strain gauge (e.g., configured as a Wheatstone Bridge circuit). The computer system may be configured to detect if a given drawer load meets or exceeds a specified threshold, indicating that the drawer may be unbalanced or exceed the ability of the actuator to transport the drawer, if an additional item of washware is added to the drawer. If the computer system determines that the given drawer load meets or exceeds a specified threshold, the computer system may be configured not to select the given drawer to receive the additional item of washware, even if the drawer has an available location to receive the additional item of washware.

By way of illustrative example, if the computer system perceives the user, and determines that the user is holding a plate within a threshold distance of the dishwasher, the dishwasher identifies a drawer that includes a rack configured to receive plates and support the plates in a substantially vertical orientation, and that has an available location to receive the plate (e.g., a lower drawer). The computer system energizes an actuator that pushes the identified drawer out enough so that the user can deposit the plate in a plate slot of the drawer.

If, instead, the computer system determines that the user is holding a drinking glass, for example, the dishwasher identifies a drawer that includes a location configured to receive drinking glasses, support the drinking glasses in a substantially vertical orientation, and that has an available location to receive the drinking glass (e.g., an upper drawer). The dishwasher energizes an actuator that pushes the upper rack out enough that the user can deposit the glass on the upper rack. In this manner, the dishwasher can assist the user and reduce the time needed to load the dishwasher and reduce the wear on dishwasher components by reducing the number of times a drawer is extended and retracted by a user attempting to determine the most suitable drawer for a given item of washware.

The actuator may include a motor controller, a motor (e.g., a stepper motor), and a transport mechanism to convert rotational movement of the motor to linear motion, enabling a drawer to be linearly transported to an extracted or retracted position. Optionally, a spring-scale may be provided to pull the drawer out. The actuator may include one or more position sensors configured to detect a position of the drawer and one or more sensors (e.g., obstacle sensors, motor current sensors, etc.) configured to detect whether the movement of the drawer has been impeded (e.g., by a misloaded item of washware, by a user, or otherwise). In response to detecting such impediment, the motor controller may halt the motor from transporting the drawer or may retract the drawer, and may generate a user alert (e.g., an audible alert, a visual alert, an electronic message transmitted to a user device, or otherwise).

As similarly discussed above, an object recognition module may be utilized to identify the presence of washware in an image captured by the dishwasher, the type of washware (e.g., drinking glass, mug, bowl, plate, ladle, salad, tongs, pot, pan, knife, fork, spoon, etc.), and/or certain dimensions of the washware (e.g., height, width, depth, circumference, radius, diameter, etc.), and/or identify certain portions of the washware (e.g., for a pot, the mouth, lip, neck, shoulder, handle, body, foot) and/or dimensions thereof. The washware may be assigned corresponding tags by the object recognition module that identify the washware type and/or optionally portions thereof and optionally dimensions thereof. Object recognition may optionally be performed using a module configured to generate and extract category independent region proposals (e.g., by generating candidate bounding boxes), using a deep neural network feature extractor configured to extract features from respective candidate regions, and using a classifier (e.g., a Support Vector Machine (SVM) classifier) configured to classify an extracted feature as one of a known class.

Optionally, the object recognition module may include an example content analysis engine that utilizes artificial intelligence and/or machine learning in performing the analysis and object recognition. For example, optionally a deep neural network model trained to classify washware may be used. The deep neural network may include an input layer, an output layer, and one or more levels of hidden layers between the input and output layers. The deep neural network may be configured as a feed forward network.

Optionally, a convolutional deep neural network may be used to analyze images and identify washware, washware types, washware portions, and/or dimensions. The convolutional deep neural network may be configured with a shared-weights architecture and with translation invariance characteristics. The hidden layers may be configured as convolutional layers, pooling layers, fully connected layers and/or normalization layers. The convolutional deep neural network may be configured with pooling layers that combine outputs of neuron clusters at one layer into a single neuron in the next layer. Max pooling and/or average pooling may be utilized. Max pooling may utilize the maximum value from each of a cluster of neurons at the prior layer. Average pooling may utilize the average value from each of a cluster of neurons at the prior layer.

The neural networks may be trained based on user feedback, where neural network layer node weights may be adjusted using backpropagation based on an error function output with respect to the correctness of washware and/or washware type identifications by the neural network.

Certain example aspects will now be described with reference to the figures.

FIG. 1 illustrates an example dishwasher 100. The dishwasher 100 includes one or more drawers 102, 104, 106. The drawers 102, 104, 106 may be off the same or different heights. The drawers 102, 104, 106 may have the same or different internal configurations. For example, drawer 102 may optionally be configured with racks configured to receive a large number of plates having a diameter of up to 12 inches in diameter, as well as having open areas to receive pots, pans, serving bowls, and other relatively large or deep items. By contrast, drawer 104 may optionally be shallower in height and may be configured with areas to receive drinking glasses having a height of up to 9 inches and a largest diameter of up to 5 inches, as well as other relatively small items. By way of further example, drawer 106 may be even shallower in height than drawer 104 and may be configured to receive spatulas, shallow pans, forks, knives, spoons, or other relatively shallow items of washware.

The dishwasher 100 includes a computer system 116. The computer system 116 may include one or more processing units (e.g., a general purpose processor such as a microprocessor, a graphics processor, an image processor), one or more network interfaces, a non-transitory computer-readable medium/drive, an analog to digital converter, a digital to analog converter, and an input/output device interface, all of which may communicate with one another by way of one or more communication buses. The disclosed sensors may be connected to the computer system 116. The analog to digital converter may be utilized to convert analog signals from sensors, such as those described herein, into the digital domain for further processing and analysis (e.g., by the processing units which may execute object recognition applications). The computer system 116 may be coupled to a dishwasher microphone (e.g., to audibly receive and execute user instructions) and a speaker (e.g., to generate audible alerts, user instructions, or to provide other information).

The processing units may thus receive information and instructions from other computing devices, systems, or services via a network. The processing units may also communicate to and from the non-transitory computer-readable medium/drive (which may store program instructions configured to cause the processing units to execute processes and functions described herein, user preferences, and/or other information) and volatile memory (e.g., RAM) that may be used as working memory, and further provide output information via the input/output device interface. The input/output device interface may also accept input from various input devices, such as a keyboard, mouse, digital pen, touch screen, microphone, cameras, other sensors, etc.

The dishwasher 100 includes one or more outward facing sensors 112-1, 112-2 configured to detect washware in the view of the sensors 112-1, 112-2. As similarly discussed elsewhere herein, the sensors 112-1, 112-2 may include imagers (e.g., cameras), LIDAR sensors, millimeter wave radars, and/or ultrasonic sonar sensors). The sensors 112-1, 112-2 may be configured to provide ranging (e.g., stereoscopic ranging) so as to enable a distance of an object (e.g., washware and/or a person) to be determined. The sensors 112-1, 112-2 may be connected to the computer system. The sensors 112-1, 112-2 may be front facing so as to view an approaching person carrying washware.

In addition, there may be one or more sensors 114-1, 114-2 configured to determine what washware is currently loaded into one or more drawers 102, 104, 106. The sensors 114-1, 114-2 may be positioned on one or more internal tub walls (e.g., a top, bottom, back, left, and/or right wall) and/or to the drawers 102, 104, 106 themselves. The sensors 114-1, 114-2 may include imagers (e.g., cameras), LIDAR sensors, millimeter wave radars, and/or ultrasonic sonar sensors.

Other sensors (not shown) may be provided, such as soil sensors configured to sense the presence and/or amount of soil of washware. By way of illustration, the soil sensor may be in the form of a turbidity sensor that measures the amount of light that is scattered by suspended solids in water. As the amount of total suspended solids in the dishwasher water increases, the water's turbidity level (e.g., cloudiness or haziness) increases, indicating an amount of soil. Other example sensors may include temperature sensors (e.g., to measure the temperature of the cleaning water), water flow sensors, and/or the like.

Each drawer 102, 104, 106 may be coupled to one or more transport mechanisms. For example, drawer 102 may be coupled to left and right transport mechanisms 108-1, 108-2. By way of further example, drawer 104 may be coupled to left and right transport mechanisms 110-1, 110-2. One or more of the transport mechanisms may be motorized. For example, a given drawer may be mounted to or positioned on two slidable glides or tracks, wherein one or both slidable glides or tracks may be coupled to an elastic or carbon belt with teeth that mesh with gears coupled to a stepper motor. As the stepper motor is commanded to rotate, the gears cause the belt to likewise rotate thereby moving the drawing in an extended or retracted direction in accordance with the commanded rotation of the motor (where the motor may be commanded to rotate in a clockwise or counterclockwise direction).

A dishwasher door 120 may include one or more controls and one or more displays. Optionally, the dishwasher door 120 may include a touchscreen display 122 on an interior and/or exterior door side (e.g., the inner side of the door, the top side of the door, and/or the outer side of the door). The touchscreen display 122 may be configured to display controls (e.g., for different wash/dry cycles), graphics, text, icons, instructions, receive user inputs (e.g., activation of a displayed control), and display drawer maps. For example, the drawer maps may indicate a recommendation as to where in a displayed drawer a user should place an item of washware as similarly described elsewhere herein. The display 122 may be, by way of example, an LCD display, an OLED display, an LED display, or other display type. The touch screen display 122 may utilize one or more technologies to detect touch, such as capacitive, resistive, infrared, surface acoustic waves, dispersive signal, optical imaging, and/or pressure sensing technologies. The dishwasher 100 may include a microphone (e.g., to receive and execute user instructions) and speaker (e.g., to generate audible alerts, user instructions, or to provide other information).

Figure 2:
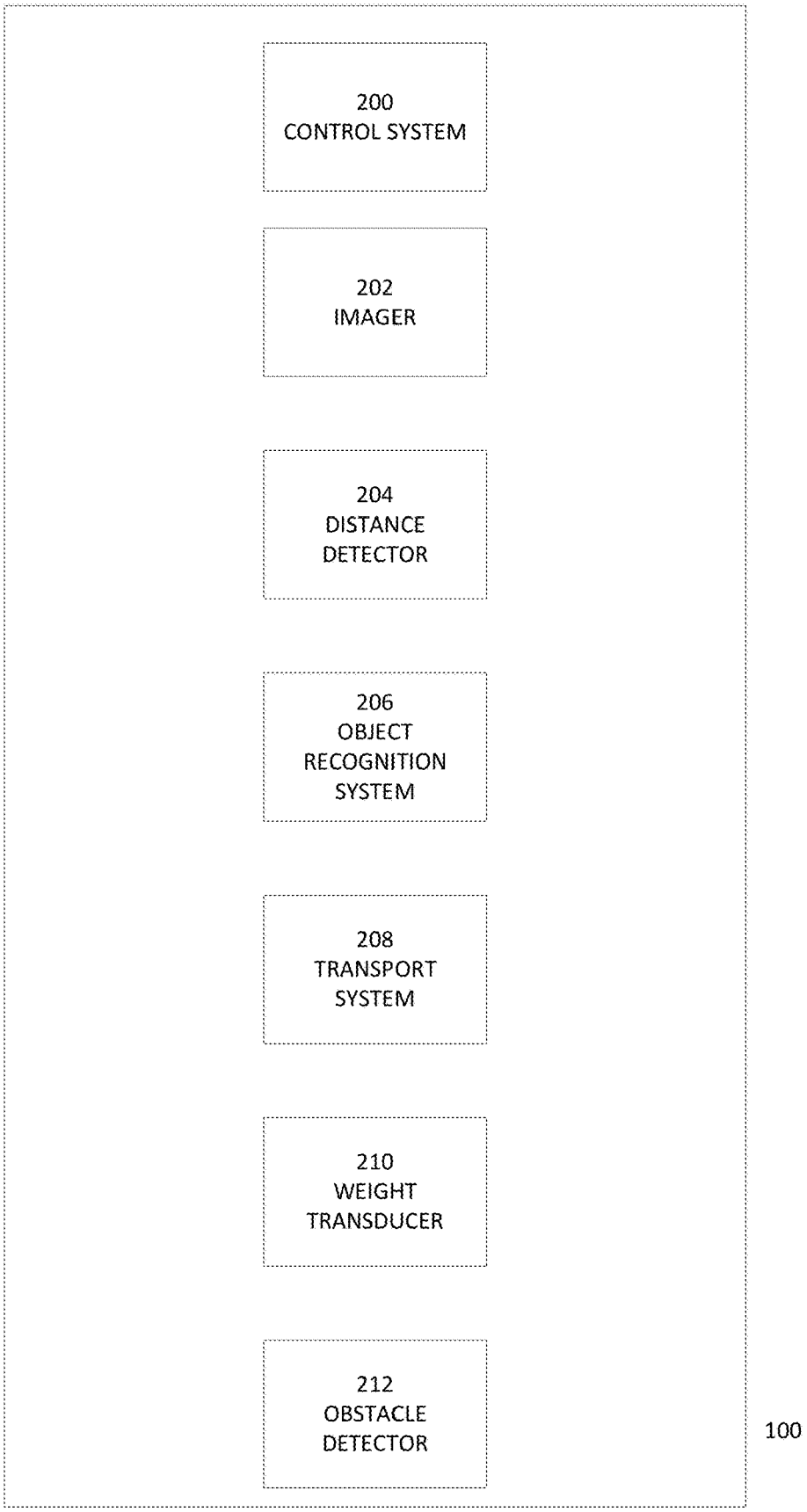
FIG. 2 illustrates an example dishwasher system architecture.

FIG. 2 illustrates an example dishwasher architecture. The dishwasher 100 may include a control system 200 which may include the computer system 116. As discussed above, non-volatile memory may store software configured to control certain functions of the dishwasher, such as wash cycles, dry cycles, drawer transport, alerts, and the like. The software may be configured to execute certain functions in response to user instructions (e.g., provided via controls affixed to the dishwasher, via an application hosted on a user device, via voice commands, or the like). The control system 200 may be configured to store in and access from memory sensor data, tags assigned to objects in images, images captured from the imager 202, other sensor data, drawer maps, and/or other data described herein.

The control system 200 may be configured to receive data via sensor signals, such as signals from sensors described herein. By way of illustration, the sensors may include an imager 202, a distance detector 204, a weight transducer 210, an obstacle detector 212, a soil sensor, a temperature sensor, a liquid flow sensor, and/or other sensors. The control system 200 may control dishwasher components used to perform washing operations, such as valves, pumps, water sprayers (e.g., rotating spray arms), water heaters, detergent dispensers, rinse aid dispensers, and/or the like.

As similarly discussed elsewhere herein, the imager 202 may be in the form of one or more cameras configured to capture still and/or video images. For example, the imager 202 may include inward facing imagers and outward facing imagers. The outward facing imagers may include stereoscopic cameras configured to capture images of people, including people holding washware. The inward facing imagers may capture images of drawer loads so that the control system 200 may determine where there is an available receiving area that is appropriately sized and shaped to receive dishware being held by the person.

A distance detector 204 may be configured to determine a distance of a person and/or an item of washware being held by the person from the dishwasher 100. The distance detector functionality may be provided by the imager 202 (e.g., in the form of stereoscopic or monoscopic ranging) or may be a separate device, such as a dedicated LIDAR and/or an ultrasonic sonar system. The distance detector 204 data may be used by the control system 200 to determine if an item of washware is within a threshold distance from the dishwasher or a portion thereof, and if the distance is within the threshold distance, infer that the person holding the washware wants to place the washware in a drawer for washing.

The weight transducer 210 may be configured to determine how heavily loaded a drawer is. The weight transducer 210 may comprise a load cell, such as a strain gauge or piezoelectric load cell. As similarly discussed elsewhere herein, that weight data provided by the weight transducer 210 may be used to ensure that the control system 200 does not recommend that an item of washware be placed in a drawer when the additional weight would overload the drawer, cause the drawer to be unbalanced, or cause the drawer weight to exceed the ability of the transport system 208 to transport the drawer.

Optionally, other sensors may be provided, such as a sensor configured to detect when the dishwasher door is in an open or closed position.

The object recognition system 206 functionality may be provided by the control system 200 or may be a distinct system with distinct circuitry. The object recognition system 206 may be configured to identify the presence of washware in an image captured by the imager 202, the type of washware (e.g., drinking glass, mug, bowl, plate, ladle, salad, tongs, pot, pan, knife, fork, spoon, etc.), and/or certain dimensions of the washware (e.g., height, width, depth, circumference, radius, diameter, etc.), and/or identify certain portions of the washware, and/or dimensions thereof. The object recognition system 206 may assign corresponding tags to portions of the image and/or to the image as a whole that identify the washware type and/or optionally portions thereof and optionally dimensions thereof.

Figure 3:
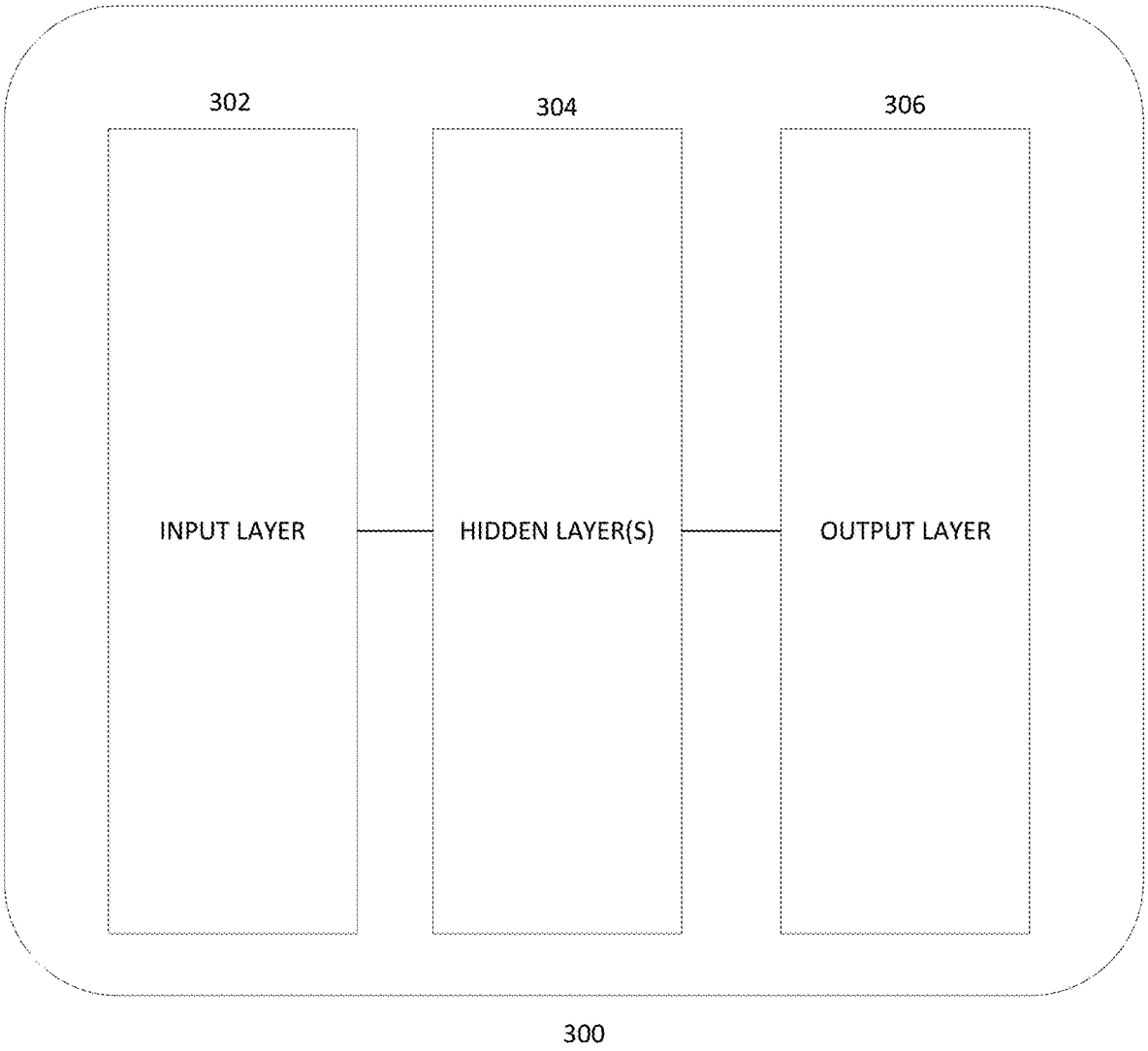
FIG. 3 illustrates an example neural network architecture.

FIG. 3 illustrates an example learning engine configured to perform object recognition to identify washware in images. The illustrated example is a neural network 300, which may be in the form of a convolutional neural network. The neural network may contain an input layer 302, one or more hidden layers 304, and an output layer 306. The hidden layers 304 may be configured as convolutional layers, pooling layers, fully connected layers and/or normalization layers. The neural network 300 may be configured with one or more pooling layers that combine outputs of neuron clusters at one layer into a single neuron in the next layer. Max pooling and/or average pooling may be utilized. Max pooling may utilize the maximum value from each of a cluster of neurons at the prior layer. Average pooling may utilize the average value from each of a cluster of neurons at the prior layer.

The neural network 300 may be trained based in a supervised or unsupervised process. For example, in supervised training user feedback may be provided indicating whether the neural network 300 correctly labeled an object, such as an item of washware. The neural network layer node weights may be accordingly adjusted using backpropagation based on an error function output) with respect to the correctness of washware and/or washware type identifications by the neural network to thereby lower the error.

The neural network 300 may be used to generate and extract category independent region proposals (e.g., by generating candidate bounding boxes) from respective candidate regions. A classifier (e.g., a Support Vector Machine (SVM) classifier trained using supervised training) may be configured to classify an extracted feature as one of a known class (e.g., a class of washware or a portion thereof).

Figure 4:
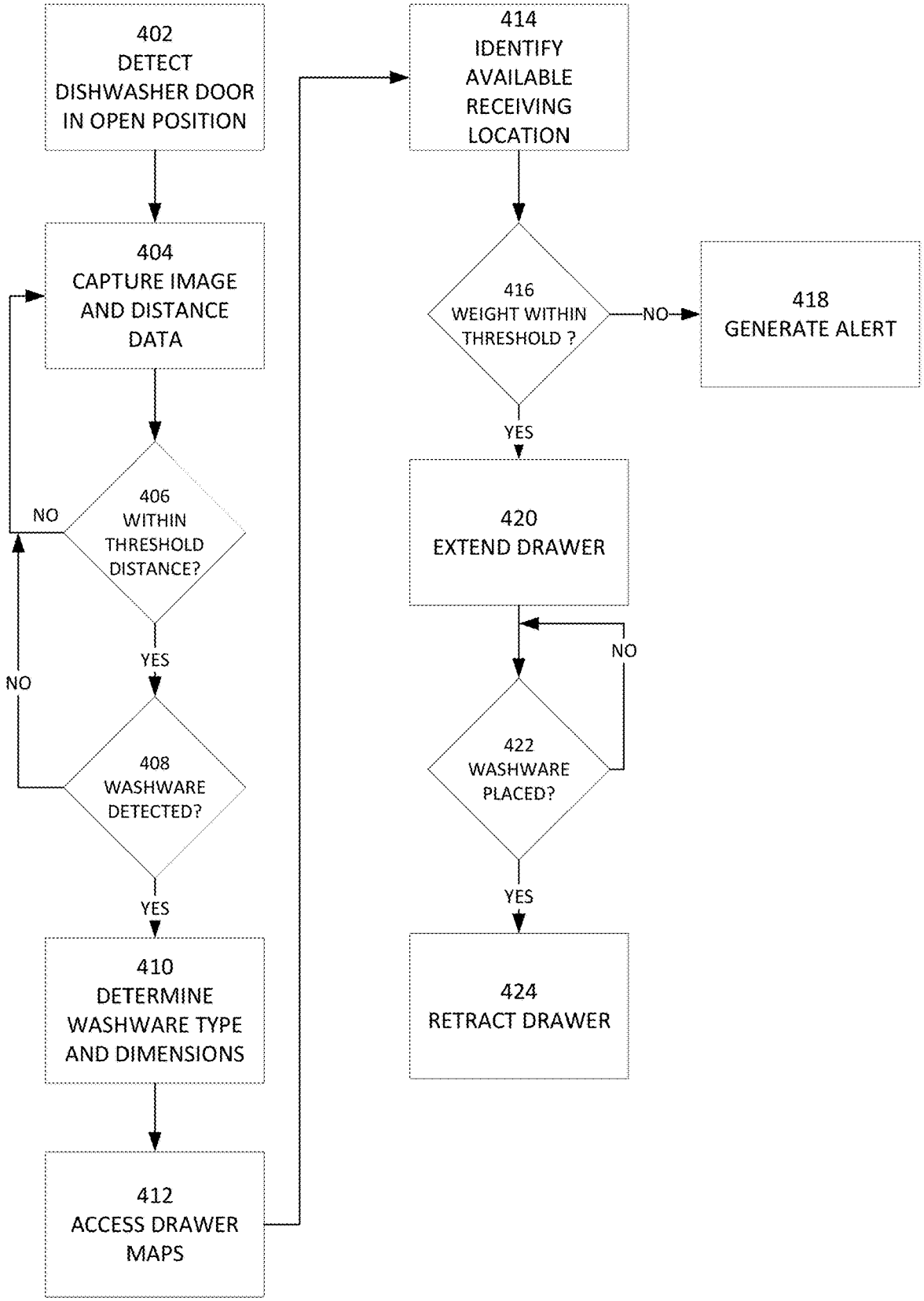
FIG. 4 illustrates an example process.

Referring now to FIG. 4, an example process is illustrated. The process may optionally be executed using systems and devices disclosed herein (e.g., as illustrated in FIGS. 1-3). Not all states of the process need to be performed.

At block 402, the process detects that a dishwasher door is open, which may indicate that a user may intend to load or unload the dishwasher. The process may detect that the dishwasher door is open via a door switch, such as an electric contacting push button switch configured to open and close a circuit depending on whether the door is open or closed. By way of further example, the door switch may be in the form of a magnetic switch.

At block 404, an imager captures images (e.g., still and/or video images) of an area in the view of the imager. Optionally, the images are only analyzed in response to detecting a person or other object in an image or in response to detecting movement of objects in the captured images, thereby reducing the consumption of computer system processor and memory resources. Motion may be detected by subtracting one image from another image, applying a threshold to the image generated by the subtraction operation to retain those pixels that exceed a threshold. This accomplishes the binarization of the generated image so that the pixels that exceed the threshold will be white and those that do not exceed the threshold will be black. Outlines or blobs in the binarized image may be detected. A blob is a set of pixels that are connected to each other has neighbors with the same value).

At block 406, a determination is made as to whether there is an object (e.g., a person or dishware) within a threshold distance of the image or other portion of the dishwasher. The threshold may be selected so that there is a higher likelihood that a dishwasher loading operation may be about to take place (e.g., 18 inches or less). The distance may be determined based on the captured images, LIDAR signal, an ultrasonic sonar signal, or otherwise. If the object is not within the threshold distance, further image analysis may be inhibited for the captured images, thereby reducing the consumption of computer system processor and memory resources.

If the object is within the threshold distance, at block 408, one or more of the captured images may be analyzed using object recognition to determine if the images include washware. As similarly discussed elsewhere herein, the object recognition may optionally be performed using a learning engine, such as a neural network (e.g., a convolutional neural network). If washware is detected, at block 410, the washware type (e.g., plate, bowl, mug, drinking glass, platter, pot, pan, serving spoon, serving fork, ladle, knife, fork, spoon, etc.) and/or dimensions of the washware may be determined using a learning engine, such as a neural network. Optionally, based on the washware type and/or dimensions, the weight of the washware may be estimated.

At block 412, drawer maps may be accessed from memory. The maps may indicate the drawer configuration, such as the position of dish holders, the spacing of dish holders, the dimensions of relatively open drawer spaces, and/or the like. In addition, the map may identify which drawer locations are occupied and/or which drawer locations are unoccupied.

At block 414, one or more available, unoccupied drawer locations for one or more drawers may be identified that are sized and configured to receive the washwear based on the washware type and/or dimensions. If two or more drawers have suitable locations, the most suitable drawer may be selected based on one or more criteria, such as the current load of each drawer, which drawer has the smallest available location that is still sized to receive the washwear, which drawer has an available location that will provide the best cleaning, and/or the like. For example, the drawer may be selected to enhance cleaning efficiency.

At block 416, the current drawer weight and/or weight load are determined for the drawers having occupied locations as identified at block 414. For example, the weight may be determined using a weight transducer, such as a strain gauge or other transducer type. A determination may be made as to whether the weight meets or exceeds a weight threshold, indicating that the drawer may be unbalanced or exceed the ability of an actuator to transport the drawer, if the washware is added to the drawer. The determination may optionally be made using an estimated weight of the imaged washware.

If the weight does not satisfy the threshold, at block 418, an alert may be generated indicating that additional washware should not be added to an identified drawer. For example, the alert may be visual (e.g., an indicator light, rendered text, rendered graphics), an audible alert, an electronic message transmitted to a user device, and/or the like).

If the weight does satisfy the threshold, at block 420, actuators for the selected drawer are activated to extend the selected drawer. Optionally, a selected drawer location for the washwear may be identified to the user via a display of a drawer map, via illuminated indicators, via voice prompts, or otherwise.

At block 422, a determination may optionally be made as to whether the washware has been placed in the extended drawer. The determination may be made, by way of example, by capturing and analyzing an image of the drawer captured via a dishwasher camera to determine if the drawer has the dishware placed therein. In addition or instead, the determination may be made, by way of example, by determining if the weight of the drawer or drawer load has changed above a certain threshold (where the threshold may optionally be based on the estimated weight of the washware).

At block 424, at least partly in response to detecting that the washware has been placed in the drawer, the drawer may be automatically commanded to retract. Optionally, in addition or instead, the drawer may be retracted in response to a user activating a retract control or in response to the user pushing the drawer in.

In response to the user activating a wash control corresponding to a wash cycle, the dishwasher may accordingly cause the wash cycle to be executed. For example, the water heater may be activated to heat the washing water, the water pump and water spray system may be activated to cause water to be sprayed on the washware in the drawers (e.g., via rotating spray arms), detergent and rinse aid may be released at appropriate times via detergent and rinse aid release dispensers.

Thus, methods and systems are described for the automated detection of washware in the vicinity of a dishwasher, the detection of suitable locations for the washware in dishwasher drawers, and the automated extension of a selected dishwasher drawer to receive the dishware. The disclosed systems and methods may enhance water use efficiency, reduce wear and tear on dishwasher components (e.g., drawer glides), and reduce the time it takes to load dishwasher drawers with washwear.

The methods and processes described herein may have fewer or additional steps or states and the steps or states may be performed in a different order. Not all steps or states need to be reached. The methods and processes described herein may be embodied in, and fully or partially automated via, software code modules executed by one or more general purpose computers. The code modules may be stored in any type of computer-readable medium or other computer storage device. Some or all of the methods may alternatively be embodied in whole or in part in specialized computer hardware. The systems described herein may optionally include displays, user input devices (e.g., touchscreen, keyboard, mouse, voice recognition, etc.), network interfaces, etc.

The results of the disclosed methods may be stored in any type of computer data repository, such as relational databases and flat file systems that use volatile and/or non-volatile memory (e.g., magnetic disk storage, optical storage, EEPROM and/or solid state RAM).

The various illustrative logical blocks, modules, routines, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

Moreover, the various illustrative logical blocks and modules described in connection with the embodiments disclosed herein can be implemented or performed by a machine, such as a general purpose processor device, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor device can be a microprocessor, but in the alternative, the processor device can be a controller, microcontroller, or state machine, combinations of the same, or the like. A processor device can include electrical circuitry configured to process computer-executable instructions. In another embodiment, a processor device includes an FPGA or other programmable device that performs logic operations without processing computer-executable instructions. A processor device can also be implemented as a combination of computing devices, e.g., a combination of a DSP and a microprocessor, a plurality of microprocessors, one or more microprocessors in conjunction with a DSP core, or any other such configuration. Although described herein primarily with respect to digital technology, a processor device may also include primarily analog components. A computing environment can include any type of computer system, including, but not limited to, a computer system based on a microprocessor, a mainframe computer, a digital signal processor, a portable computing device, a device controller, or a computational engine within an appliance, to name a few.

The elements of a method, process, routine, or algorithm described in connection with the embodiments disclosed herein can be embodied directly in hardware, in a software module executed by a processor device, or in a combination of the two. A software module can reside in RAM memory, flash memory, ROM memory, EPROM memory, EEPROM memory, registers, hard disk, a removable disk, a CD-ROM, or any other form of a non-transitory computer-readable storage medium. An exemplary storage medium can be coupled to the processor device such that the processor device can read information from, and write information to, the storage medium. In the alternative, the storage medium can be integral to the processor device. The processor device and the storage medium can reside in an ASIC. The ASIC can reside in a user terminal. In the alternative, the processor device and the storage medium can reside as discrete components in a user terminal.

Conditional language used herein, such as, among others, "can," "may," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

While the phrase "click" may be used with respect to a user selecting a control, menu selection, or the like, other user inputs may be used, such as voice commands, text entry, gestures, etc. User inputs may, by way of example, be provided via an interface, such as via text fields, wherein a user enters text, and/or via a menu selection (e.g., a drop down menu, a list or other arrangement via which the user can check via a check box or otherwise make a selection or selections, a group of individually selectable icons, etc.). When the user provides an input or activates a control, a corresponding computing system may perform the corresponding operation. Some or all of the data, inputs and instructions provided by a user may optionally be stored in a system data store (e.g., a database), from which the system may access and retrieve such data, inputs, and instructions. The notifications/alerts and user interfaces described herein may be provided via a Web page, a dedicated or non-dedicated phone application, computer application, a short messaging service message (e.g., SMS, MMS, etc.), instant messaging, email, push notification, audibly, a pop-up interface, and/or otherwise.

The user terminals described herein may be in the form of a mobile communication device (e.g., a cell phone), laptop, tablet computer, interactive television, game console, media streaming device, head-wearable display, networked watch, etc. The user terminals may optionally include displays, user input devices (e.g., touchscreen, keyboard, mouse, voice recognition, etc.), network interfaces, etc.

While the above detailed description has shown, described, and pointed out novel features as applied to various embodiments, it can be understood that various omissions, substitutions, and changes in the form and details of the devices or algorithms illustrated can be made without departing from the spirit of the disclosure. As can be recognized, certain embodiments described herein can be embodied within a form that does not provide all of the features and benefits set forth herein, as some features can be used or practiced separately from others. The scope of certain embodiments disclosed herein is indicated by the appended claims rather than by the foregoing description. All changes which come within the meaning and range of equivalency of the claims are to be embraced within their scope.

What is claimed is:

1. A dishwasher, comprising:

an image sensor;

a first drawer configured to receive washware;

a second drawer configured to receive washware;

a first actuator configured to extend or retract the first drawer configured to receive washware;

a second actuator configured to extend or retract the second drawer configured to receive washware;

a computer system configured to:

receive one or more images from the image sensor;

determine whether an object is moved to within a threshold distance of a first portion of the dishwasher;

at least partly in response to determining that an object is moved to within the threshold distance of the first portion of the dishwasher, using a washwear recognition system to determine whether the object comprises an item of washwear;

at least partly in response to determining that the object comprises an item of washwear, use a determined washwear type and a washwear dimension to identify an unoccupied location in the first drawer and/or second drawer of a size and configured suitable to receive the item of washwear; and at least partly in response to identifying an unoccupied location in the first drawer and/or second drawer of a size and configured suitable to receive the item of washwear, command an actuator among the first actuator and the second actuator to extend a corresponding drawer to thereby receive the item of dishware.

2. The dishwasher as defined in claim 1, wherein the image sensor comprises a stereoscopic image sensor configured to perform stereoscopic ranging.

3. The dishwasher as defined in claim 1, further comprising a distance sensor configured to determine a distance of objects from the first portion of the dishwasher.

4. The dishwasher as defined in claim 1, wherein the washwear recognition system comprises an input layer, one or more hidden layers, and an output layer.

5. The dishwasher as defined in claim 1, wherein the washwear type is determined using a learning engine, wherein the washwear type is selected from a washwear set comprising bowl and plate.

6. The dishwasher as defined in claim 1, wherein the computer system is configured to inhibit a drawer from being extended to receive at least one item of washwear in response a weight determination related to the drawer.

7. The dishwasher as defined in claim 1, wherein the computer system is configured to identify the unoccupied location of the extended drawer to a user via a visual and/or audible identification.

8. The dishwasher as defined in claim 1, wherein the computer system is configured to maintain a map of occupied locations of the first drawer and the second drawer.

9. The dishwasher as defined in claim 1, wherein the computer system is configured a display configured to indicate the identified unoccupied location.

10. A computer-implemented method comprising:

receiving at a computer system of a dishwasher one or more images from an image sensor;

using a washwear recognition system to determine whether the image comprises an item of washwear;

at least partly in response to determining that the image comprises an item of washwear, use a determined washwear type and/or a washwear dimension to identify an unoccupied location in a dishwasher drawer of a size and configured suitable to receive the item of washwear; and at least partly in response to identifying an unoccupied location in the dishwasher drawer of a size and configured suitable to receive the item of washwear, commanding an actuator to extend the drawer to thereby receive the item of dishware.

11. The method as defined in claim 10, wherein the image sensor comprises a stereoscopic image sensor configured to perform stereoscopic ranging.

12. The method as defined in claim 10, further comprising using a distance sensor configured to determine a distance of objects from a first portion of the dishwasher.

13. The method as defined in claim 10, wherein the washwear recognition system comprises an input layer, one or more hidden layers, and an output layer.

14. The method as defined in claim 10, wherein the washwear type is determined using a learning engine, wherein the washwear type is selected from a washwear set comprising bowl and plate.

15. The method as defined in claim 10, the method further comprising inhibiting the drawer from being extended to receive at least one item of washwear in response a weight determination related to the drawer.

16. The method as defined in claim 10, the method further comprising identifying the unoccupied location of the extended drawer to a user via a visual and/or audible identification.

17. The method as defined in claim 10, the method further comprising maintaining a map of occupied locations of the drawer.

18. The method as defined in claim 10, the method further comprising causing a display to indicate the identified unoccupied location.

19. Non-transitory memory that stores instructions that when executed by a computer system causes the computer system to perform operations comprising:

receiving one or more images from an image sensor of a dishwasher;

using a washwear recognition module to determine whether the image comprises an item of washwear;

at least partly in response to determining that the image comprises an item of washwear, use a determined washwear type and/or a washwear dimension to identify an unoccupied location in a dishwasher drawer of a size and configured suitable to receive the item of washwear; and at least partly in response to identifying an unoccupied location in the dishwasher drawer of a size and configured suitable to receive the item of washwear, commanding an actuator to extend the drawer to thereby receive the item of dishware.

20. The non-transitory memory as defined in claim 19 wherein the image sensor comprises a stereoscopic image sensor configured to perform stereoscopic ranging.

21. The non-transitory memory as defined in claim 19, the operations further comprising using a distance sensor configured to determine a distance of objects from a first portion of the dishwasher.

22. The non-transitory memory as defined in claim 19, wherein the washwear recognition system comprises an input layer, one or more hidden layers, and an output layer.

23. The non-transitory memory as defined in claim 19, wherein the washwear type is determined using a learning engine, wherein the washwear type is selected from a washwear set comprising bowl and plate.

24. The non-transitory memory as defined in claim 19, the operations further comprising inhibiting the drawer from being extended to receive at least one item of washwear in response a weight determination related to the drawer.

25. The non-transitory memory as defined in claim 19, the operations further comprising identifying the unoccupied location of the extended drawer to a user via a visual and/or audible identification.

26. The non-transitory memory as defined in claim 19, the operations further comprising maintaining a map of occupied locations of the drawer.

27. The non-transitory memory as defined in claim 19, the operations further comprising causing a display to indicate the identified unoccupied location.

* * * * *